US007810741B2

(12) United States Patent
Kowalski et al.

(10) Patent No.: US 7,810,741 B2
(45) Date of Patent: Oct. 12, 2010

(54) METHOD OF ADJUSTING THE HEIGHT OF A FIXED RAIL CARRIAGEWAY

(75) Inventors: Martin Kowalski, Nuremberg (DE); Stephan Freudenstein, Neumarkt (DE)

(73) Assignee: Rail.One GmbH, Neumarkt (DE)

( * ) Notice: Subject to any disclaimer, the term of this patent is extended or adjusted under 35 U.S.C. 154(b) by 604 days.

(21) Appl. No.: 10/592,810

(22) PCT Filed: Mar. 20, 2006

(86) PCT No.: PCT/DE2006/000501

§ 371 (c)(1),
(2), (4) Date: Sep. 14, 2006

(87) PCT Pub. No.: WO2006/102866

PCT Pub. Date: Oct. 5, 2006

(65) Prior Publication Data

US 2008/0257971 A1 Oct. 23, 2008

(30) Foreign Application Priority Data

Mar. 26, 2005 (DE) ..... 10 2005 013 947

(51) Int. Cl.
*E01B 21/00* (2006.01)

(52) U.S. Cl. ..... 238/2

(58) Field of Classification Search ..... 238/2, 238/5, 6, 7, 29, 30, 83
See application file for complete search history.

(56) References Cited

U.S. PATENT DOCUMENTS

2004/0099750 A1* 5/2004 Reichel et al. ..... 238/7
2004/0182946 A1* 9/2004 Reichel et al. ..... 238/5

FOREIGN PATENT DOCUMENTS

| | | |
|---|---|---|
| DE | 196 31 430 | 2/1998 |
| DE | 196 39 142 | 4/1998 |
| DE | 196 53 858 | 6/1998 |
| DE | 198 34 072 | 2/1999 |
| DE | 198 34 060 | 4/1999 |
| DE | 198 48 655 | 11/1999 |
| WO | WO-02/22957 | 3/2002 |

* cited by examiner

*Primary Examiner*—S. Joseph Morano
*Assistant Examiner*—Robert J McCarry, Jr.
(74) *Attorney, Agent, or Firm*—Jordan and Hamburg LLP

(57) ABSTRACT

Method of adjusting the height of a fixed rail carriageway, in which the sleepers supporting the rails are embedded in a carriageway panel resting on a substrate includes the steps of separating the carriageway panel from the substrate at the common contact face, forming filling apertures extending from the upper face to the lower face of the carriageway panel, lifting the carriageway panel to a fixed target height, incorporating a flowable casting material through the filling apertures in order to fill the space between the carriageway panel and the substrate, wherein separation is effected by pressure impacts.

26 Claims, 2 Drawing Sheets

METHOD OF ADJUSTING THE HEIGHT OF A FIXED RAIL CARRIAGEWAY

Figure 1:
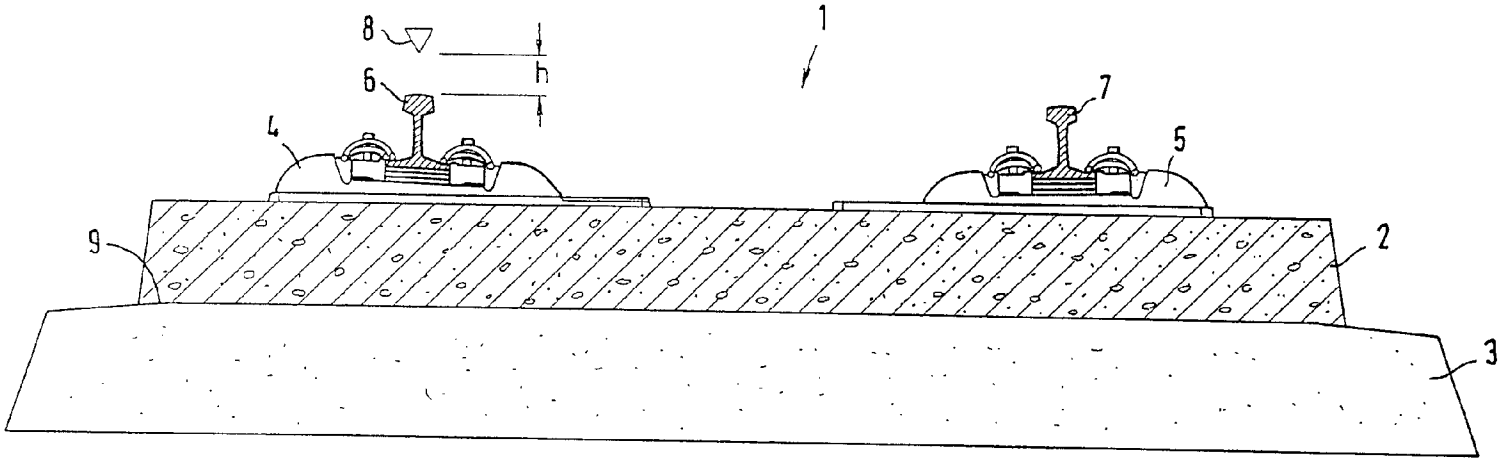

The invention relates to a method of adjusting the height of a fixed rail carriageway in which the sleepers supporting the rails are embedded in a carriageway panel resting on a substrate.

Various methods of manufacturing fixed rail carriageways have already been disclosed, e.g. by DE 196 53 858 A1. In general, with fixed rail carriageways, the sleepers supporting the rails are embedded in a carriageway panel by casting. The carriageway panel in turn rests on a substrate, the term "substrate" being used in the present patent application to represent various types of substructure which may include for example a hydraulically bonded support layer (HGT).

In practice, the problem has arisen that the actual height of the rails deviates over time from the specified target height, these deviations usually being ascribable to settlement of the substructure. In the ballast tracks formerly used, such faults can be remedied relatively simply by plugging operations. In the case of rails in the form of a fixed carriageway, in particular with concrete constructions, there is a possibility of compensating to a limited degree the height differences which have arisen in the region of the rail support points. With this method, however, only a comparatively slight height difference can be adjusted. In the case of massive settlement, however, it is not possible to regain the target height of the rails solely within the rail support points.

In DE 196 31 430 C2, a method is described for incorporating filler material between two layers of a fixed carriageway for rail vehicles. The filler material is in the form of a liquid and is incorporated or squeezed into the fixed carriageway through apertures.

In DE 198 48 655 A1, a method is described for renovating fixed carriageways in which the layers of the fixed carriageway are separated by mechanical means, e.g. separation can be carried out by means of a wedge, by saws or by water-jet cutting.

The problem on which the invention is based is to indicate a method for the height adjustment of a fixed rail carriageway, which can be used even if there are relatively great height differences and with which the layers can be reliably separated.

To solve this problem, according to the invention a method of adjusting the height of a fixed rail carriageway is proposed comprising the following steps:

- separation of the carriageway panel from the substrate at the common contact face,
- formation of filling apertures extending from the upper face to the lower face of the carriageway panel,
- lifting of the carriageway panel to a fixed target height,
- introduction of a flowable casting material through the filling apertures in order to fill the space between the carriageway panel and the substrate, separation being effected by pressure impacts.

The invention is based on the realisation that height adjustment is not only possible by measures in the region of the rail support points, but can be effected by lifting of the entire carriageway panel. According to the invention, to this end the carriageway panel is separated from the substrate or substructure or the hydraulically bonded support layer by pressure impacts in such a manner that none of the parts is damaged. Then, perpendicular to the carriageway panel, filling apertures are formed at regular intervals. With suitable aids, the carriageway panel resting loosely on the substrate is lifted and moved into the desired target position, in particular to the target height and is fixed there. Then, a flowable casting material is introduced through the filling apertures and flows through the filling apertures into the space between the carriageway panel and the substrate until the entire gap between the carriageway panel and the substrate is filled up. After hardening of the casting material, the rail carriageway is permanently fixed in the specified target height.

In the method according to the invention, it is preferred that the filling apertures are formed in the carriageway panel in the region of the rails. It is advantageous if transverse to the rails plural, preferably two, filling apertures are formed. Alternatively, or in addition, optionally plural filling apertures can be formed in the longitudinal direction of the rails, their number depending on the length of the track section to have its height adjusted.

The necessary filling apertures can be drilled while the method according to the invention is being carried out. In order to simplify the incorporation of the casting material, this can be poured in, squeezed in or injected.

In order that after carrying out the method according to the invention for height adjustment, the necessary carrying capacity is available, in particular concrete or concrete substitute systems are used as casting material.

In the method according to the invention, the separation of the carriageway panel from the substrate can be carried out in particular by pneumatic pressure impacts. It is advantageous if, before separation, apertures are generated for incorporating the pressure impact tools.

If necessary, separation can additionally be carried out by horizontally disposed, force-generating elements such as hydraulic cylinders. As a further option, it can be provided to separate the carriageway panel by means of a horizontally disposed cable saw.

Figure 2:
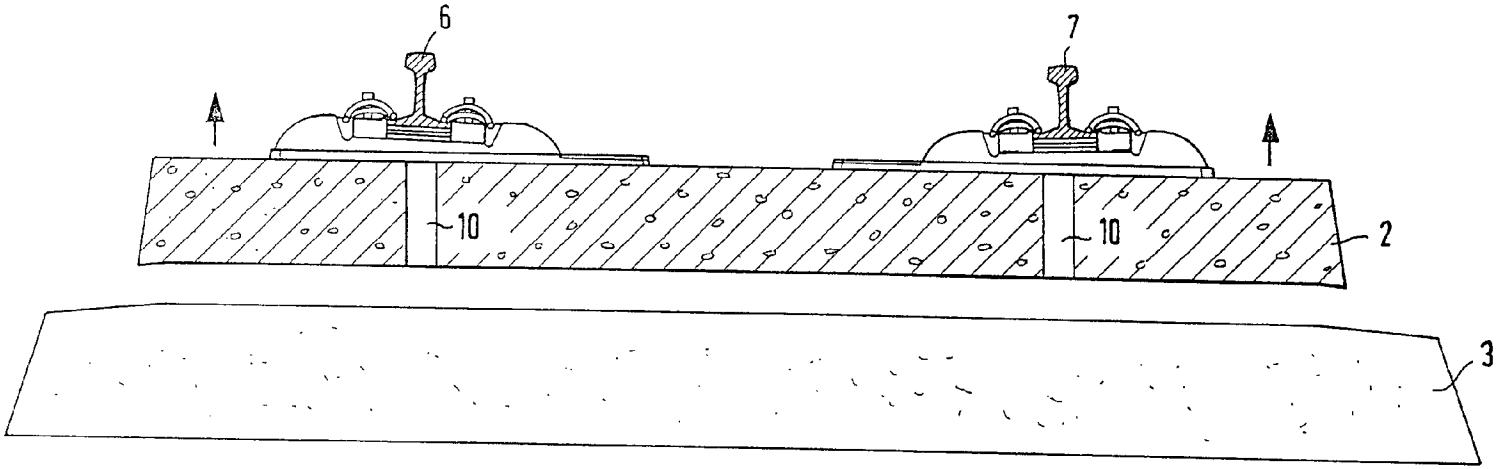
Figure 3:
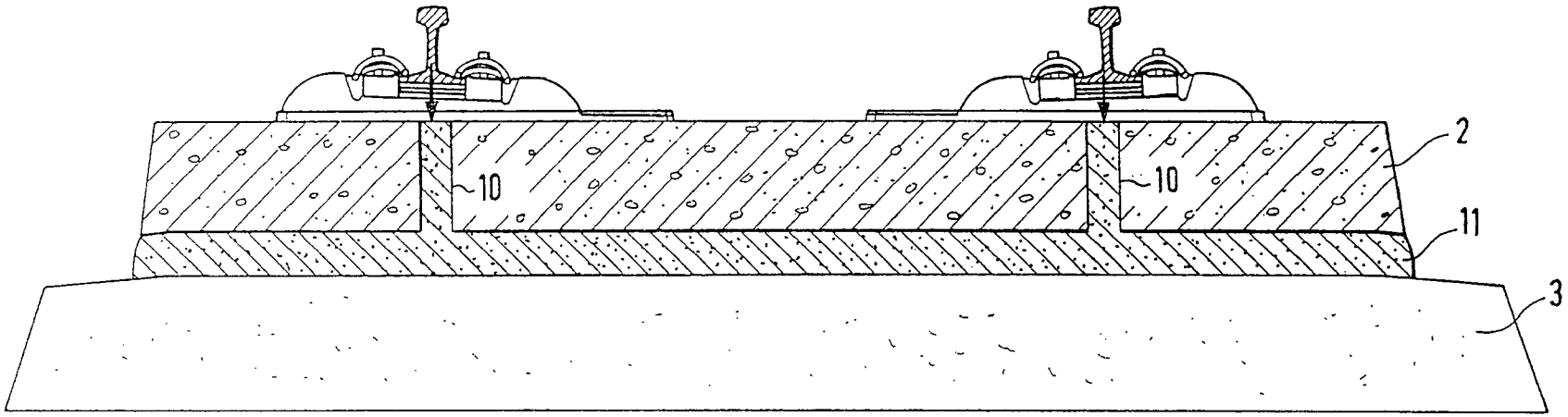

Further advantages and details of the invention will be explained by means of an embodiment with reference to the Figures, which are schematic section diagrams and show:

FIG. 1 a fixed rail carriageway, in which the carriageway panel has been separated from the substrate according to the method according to the invention;

FIG. 2 the fixed rail carriageway shown in FIG. 1 with the filling apertures formed after lifting; and FIG. 3 the fixed rail carriageway with the casting material squeezed in.

The fixed rail carriageway 1 shown in FIG. 1 consists essentially of a carriageway panel 2 composed of concrete, which rests on a substrate 3. In the embodiment shown, the substrate is formed as a hydraulically bonded support layer.

In the carriageway panel 2, sleepers are embedded, whose single blocks 4, 5 support rails 6, 7. In FIG. 1, a triangle 8 is shown as a marker, whose lower point indicates the target height of the rail 6. Due to settlement of the substrate 3, the height difference h has occurred, which indicates the deviation between the target height and the actual height of the rail 6.

In order to adjust this height difference, the carriageway panel 2 is separated from the substrate 3 by pressure impacts, care being taken that the carriageway panel 2 and the substrate 3 are not damaged. Accordingly, separation is effected exactly at the contact face 9 between the carriageway panel 2 and the substrate 3. After separation, the carriageway panel 2 rests loosely on the substrate 3.

FIG. 2 shows the fixed rail carriageway shown in FIG. 1 with the filling apertures formed after lifting.

Filling apertures 10 are drilled in the carriageway panel 2. The filling apertures 10 extend transverse to the carriageway panel 2 from the upper face to the lower face. In the longitudinal direction of the rails, a large number of such filling apertures are drilled at regular intervals. In addition to the two filling apertures 10 shown in FIG. 2, further filling apertures may be present, which can also be staggered in the rail longitudinal direction.

After the drilling of the filling apertures 10, the carriageway panel 2 resting loosely on the substrate 3 is lifted. To this end, a suitable lifting means is used, which makes it possible to indicate and adjust the rails 6, 7 precisely to the target height. When this adjustment is complete, the "floating" carriageway panel 2 is fixed in this position.

FIG. 3 shows the fixed rail carriageway after the injection of the casting material.

After fixing of the carriageway panel 2, casting material 11 is injected via the filling apertures 10. The casting material 11 passes into the gap between the lower face of the carriageway panel 2 and the upper face of the substrate 3 and completely fills this gap. The viscosity of the casting material 11 is so selected that it does not run out of the open sides. At the sides of the carriageway panel 2, casing can also be applied, which is removed again after hardening of the casting material 11. To inject the casting material 11, a pump or other suitable tool can be used. After hardening of the casting material 11, the process of adjusting the height is complete, and then the rail carriageway 1 is available raised to the specified target height with the same carrying capacity as before the measure was carried out.

The invention claimed is:

1. A method of adjusting a height of a fixed rail carriageway, in which sleepers supporting rails are embedded in a carriageway panel resting on a substrate, comprising:

separating the carriageway panel from the substrate at an interface defined by mutually contacting surfaces of said carriageway panel and said substrate, said separating being effected by pressure impacts;

forming filling apertures extending from the upper face to the lower face of the carriageway panel;

lifting the carriageway panel to a fixed target height; and incorporating a flowable casting material through the filling apertures in order to fill the space between the carriageway panel and the substrate.

2. A method according to claim 1, wherein the filling apertures are formed in the carriageway panel in a region of the rails.

3. A method according to claim 1, wherein the filling apertures are formed transverse to the rails.

4. A method according to claim 1, wherein the filling apertures are formed staggered in a longitudinal direction of the rails.

5. A method according to claim 1, wherein said forming filling apertures includes drilling through said carriageway panel.

6. A method according to claim 1, wherein the casting material is poured, injected or squeezed in through said filling apertures.

7. A method according to claim 1, wherein concrete or concrete substitute systems are used as the casting material.

8. A method according to claim 1, wherein before said separating, apertures are produced for inserting pressure impact tools.

9. A method according to claim 1, wherein said separating is carried out by means of horizontally disposed force-generating elements.

10. A method according to claim 9, wherein said horizontally disposed force-generating elements include hydraulic cylinders.

11. A method according to claim 1, wherein said separating is carried out by means of a horizontal cable saw.

12. A method according to claim 1, wherein two filling apertures are formed transverse to the rails.

13. A method according to claim 1, wherein said separating is carried out by means of horizontally disposed hydraulic cylinders.

14. A method according to claim 1, wherein the filling apertures are disposed in staggered positions in a longitudinal direction of the rails.

15. A method according to claim 1, wherein said forming filling apertures is carried out after said separating.

16. A method according to claim 1, wherein said forming filling apertures is carried out at a location at which the carriageway panels are already installed.

17. A method according to claim 1, wherein said separating is conducted in a manner which avoids damage to the carriageway panel and the substrate.

18. A method of adjusting a height of a fixed rail carriageway, in which sleepers supporting rails are embedded in a carriageway panel resting on a substrate, comprising:

separating the carriageway panel from the substrate at an interface defined by mutually contacting surfaces of said carriageway panel and said substrate, said separating being effected by pneumatic pressure impacts;

forming filling apertures extending from the upper face to the lower face of the carriageway panel;

lifting the carriageway panel to a fixed target height; and incorporating a flowable casting material through the filling apertures in order to fill the space between the carriageway panel and the substrate.

19. A method of adjusting a height of a fixed rail carriageway, in which sleepers supporting rails are affixed to a carriageway panel resting on a substrate, comprising:

providing filling apertures extending from an upper face to a lower face of the carriageway panel;

separating the carriageway panel from the substrate at an interface defined by mutually contacting surfaces of said carriageway panel and said substrate, said separating being effected by pressure impacts;

lifting the carriageway panel to a fixed target height; and introducing a flowable casting material through the filling apertures from the upper face to the lower face of the carriageway panel in order to fill the space between the carriageway panel and the substrate to maintain said carriageway panel at said target height.

20. A method according to claim 19, wherein the filling apertures are formed in the carriageway panel in a region of the rails.

21. A method according to claim 19, wherein said filling apertures are disposed transverse to the rails.

22. A method according to claim 19, wherein the casting material is poured, injected or squeezed in through said filling apertures.

23. A method according to claim 19, wherein concrete or concrete substitute systems are used as the casting material.

24. A method according to claim 15, wherein said forming filling apertures is carried out after said separating.

25. A method according to claim 15, wherein said forming filling apertures is carried out at a location at which the carriageway panels are already installed.

26. A method according to claim 15, wherein said separating is conducted in a manner which avoids damage to the carriageway panel and the substrate.

* * * * *